US006989087B2

(12) United States Patent
Lansdell et al.

(10) Patent No.: US 6,989,087 B2
(45) Date of Patent: Jan. 24, 2006

(54) METAL FINISHES

(75) Inventors: Paul Averell William Lansdell, Coleford (GB); John Peter George Farr, Handsworth (GB)

(73) Assignee: Kohler Mira Ltd., Gloucestershire (GB)

( * ) Notice: Subject to any disclaimer, the term of this patent is extended or adjusted under 35 U.S.C. 154(b) by 187 days.

(21) Appl. No.: 10/433,834

(22) PCT Filed: Dec. 10, 2001

(86) PCT No.: PCT/GB01/05474

§ 371 (c)(1),
(2), (4) Date: Jun. 9, 2003

(87) PCT Pub. No.: WO02/46500

PCT Pub. Date: Jun. 13, 2002

(65) Prior Publication Data

US 2004/0040859 A1 Mar. 4, 2004

(30) Foreign Application Priority Data

Dec. 8, 2000 (GB) ..... 0029954

(51) Int. Cl.
*C25D 3/06* (2006.01)
*C25D 5/12* (2006.01)
*C25D 5/48* (2006.01)

(52) U.S. Cl. ..... 205/178; 205/179; 205/220; 205/287; 428/673; 428/666; 428/935; 428/626

(58) Field of Classification Search ..... 428/673, 428/666, 935, 621, 626, 704; 205/178, 179, 205/220, 287
See application file for complete search history.

(56) References Cited

U.S. PATENT DOCUMENTS

| | | | | |
|---|---|---|---|---|
| 2,714,088 | A * | 7/1955 | Karash | 205/178 |
| 2,928,169 | A | 3/1960 | Beach et al. | |
| 3,298,802 | A | 1/1967 | Odekerken | |
| 4,159,230 | A | 6/1979 | Barnes et al. | |
| 4,169,022 | A | 9/1979 | Ward et al. | |
| 4,477,318 | A | 10/1984 | Tomaszewski | |

FOREIGN PATENT DOCUMENTS

| | | | |
|---|---|---|---|
| CA | 1120420 | * | 3/1982 |
| JP | 48-21638 | * | 3/1973 |

* cited by examiner

*Primary Examiner*—John J. Zimmerman
(74) *Attorney, Agent, or Firm*—Greer, Burns & Crain, Ltd.

(57) ABSTRACT

A method of forming a surface finish of trivalent chromium on metal or plastics substrates by electrodeposition from an aqueous plating solution of trivalent chromium ions in which the trivalent chromium is deposited on a layer of silver or silver alloy whereby the color and/or corrosion resistance of the trivalent chromium is comparable to surface finishes of hexavalent chromium. The invention avoids the health and safety risks associated with the electrodeposition of hexavalent chromium surface finishes.

13 Claims, 3 Drawing Sheets

| |
|---|
| Phosphate dip |
| Trivalent Chromium |
| Silver or Silver alloy |
| Base Metal |

| |
|---|
| Phosphate dip |
| Trivalent Chromium |
| Silver or Silver alloy |
| Nickel |
| Base Metal |

| |
|---|
| Phosphate dip |
| Trivalent Chromium |
| Silver or Silver alloy |
| Nickel |
| Copper |
| Base Metal |

| |
|---|
| Phosphate dip |
| Trivalent Chromium |
| Silver or Silver alloy |
| Any combination of deposited layers or treatments |
| Base Material |

| |
|---|
| Phosphate dip |
| Trivalent Chromium |
| Silver or Silver alloy |
| Nickel |
| Copper |
| Various surface treatments inc. plating |
| Base Material |

*Fig 3*

METAL FINISHES

BACKGROUND OF THE INVENTION

This invention concerns improvements relating to metal finishes and in particular to the electrodeposition of chromium to provide a decorative and protective surface finish.

More especially, the invention concerns the corrosion resistance of chromium finishes and how this can be improved at least for certain types of plating solutions giving benefits for the manufacture of articles having a decorative and protective chromium finish.

Electrodeposition of chromium from chromium plating baths is especially suited to provide consumer products with a tough, hard wearing surface finish that is corrosion resistant. As a result, industry has come to rely heavily upon chromium plating to provide an easily obtainable durable surface finish.

For many applications, particularly over zinc and brass, the normal process is to deposit copper, with bright nickel and chromium on top to produce a bright, hard wearing and corrosion resistant surface finish. In most copper alloy based situations the initial copper layer is omitted.

The chromium surface finish provides good corrosion resistance in many environments but, in the household kitchen or bathroom environment, chromium plated articles spend a significant proportion of their time covered in a film of water and soap and this has been found to lead to a reduced corrosion resistance.

The problem is believed to be due not to corrosion of the chromium deposit itself but the result of corrosion of the nickel layer where it is exposed due to faults in the chromium deposit either as formed or resulting from use.

The corrosion of the nickel is caused by electrical activity resulting from the interaction between the nickel and the chromium in the alkaline environment that exists in household kitchens and bathrooms due to the soaps and cleaners currently used. Also present in this environment from both the water and the cleaners, in varying amounts, is the chloride ion.

The corrosion reactions taking place in the alkaline environment produce soluble corrosion products allowing the corrosion to spread, eventually releasing the chromium from the corroding nickel and ultimately exposing the base metal. Corrosion resistance can be extended by the intermediate deposition of a layer of semi bright nickel beneath the bright nickel layer but this adds to manufacturing costs both in terms of increased production times and higher material costs and does not prevent the corrosion reactions from taking place once the nickel is exposed.

Chromium has two stable valency configurations, the hexavalent state and the trivalent state. Traditionally, metallic chromium deposits are obtained using plating solutions of hexavalent chromium. The reason for this is that the majority of decorative deposits obtained from plating solutions of hexavalent chromium are non porous continuous films which prevent the corrosion reactions taking place unless there is a fault in the chromium deposit either as formed or resulting from damage or wear in use so as to expose the underlying nickel.

In contrast, the deposits from the plating solutions of trivalent chromium are microporous films with holes through to the surface of the nickel underlayer. These holes are invisible to the naked eye but the nickel underlayer is exposed allowing the corrosion reactions to take place.

The known plating solutions of hexavalent chromium are typically based on the compound chromic oxide ($CrO_3$).

When dissolved in water, this forms chromic acid which is a strongly acidic, oxidising solution that has been found to be carcinogenic. Plating processes using these solutions therefore present a serious health and safety hazard to the people using them and a pollution risk to the environment.

The trivalent state is known to be comparatively benign and plating solutions of trivalent chromium are less aggressive. The use of plating solutions of trivalent chromium is therefore desirable to reduce the health and safety risks to the people using them and the pollution risk to the environment but to date has not been widely adopted because of increased chemical control required to maintain them at optimum operating conditions.

Thus, trivalent chromium plating solutions are more susceptible to the ingress of tramp metals and quickly require correction to maintain their efficiency. Hexavalent chromium plating solutions on the other hand are more robust and require very little routine attention.

Another problem is that existing plating solutions of trivalent and hexavalent chromium produce surface finishes of different colour. In particular, trivalent chromium plating is darker than hexavalent chromium plating.

This difference in colour is readily discernible when comparing parts plated with hexavalent chromium and parts plated with trivalent chromium. As a result of the colour mis-match, it is not possible to mix parts plated with trivalent chromium and parts plated with hexavalent chromium.

Thus, where several parts to be assembled or used together are chromium plated, care is required to ensure a colour match is achieved. This has resulted in the use of hexavalent chromium plating in preference to trivalent chromium plating because of the afore-mentioned problems associated with trivalent chromium plating solutions and finishes.

The present invention has been made from a consideration of the problems aforementioned.

To this end, it is an object of the present invention to provide a surface finish of chromium having improved corrosion resistance.

More particularly, it is a preferred object of the present invention to provide a surface finish of chromium produced by an electrodeposition process from an aqueous plating bath containing hexavalent or trivalent chromium ions having improved corrosion resistance to surface finishes of chromium currently available.

It is a further desired object of the invention to provide a surface finish of chromium having improved corrosion resistance which can be produced using a plating solution of trivalent chromium ions.

It is yet another preferred object of the invention to provide a surface finish of trivalent chromium having improved corrosion resistance which substantially matches the colour of existing surface finishes of hexavalent chromium.

SUMMARY OF THE INVENTION

These objects are broadly achieved according to one aspect of the present invention by a process in which the reactions that cause corrosion of a chromium plated surface finish are inhibited.

More particularly, the present invention provides a process for inhibiting the corrosion reactions whereby the corrosion resistance of chromium deposited from aqueous plating solutions of chromium ions is enhanced.

The process preferably includes pre-treatment of a substrate prior to applying a surface finish of chromium and/or post-treatment of the chromium surface finish to enhance the corrosion resistance of the substrate.

The pre-treatment enhances the corrosion resistance by inhibiting the corrosion reactions which cause the chromium to separate from the substrate when exposed to the environment through the chromium surface finish.

The post-treatment further enhances the corrosion resistance by inhibiting exposure of the substrate to the environment through the chromium surface finish and thereby preventing the corrosion reactions which cause the chromium to separate from the substrate.

The improved corrosion resistance produced by the process of the present invention has application for surface finishes of hexavalent chromium by providing increased protection of the substrate to the effects of the environment on articles to which the surface finish of hexavalent chromium has been applied.

More preferably, however, the improved corrosion resistance of the invented process enables surface finishes of trivalent chromium to be obtained having a corrosion resistance comparable with or better than existing surface finishes of hexavalent chromium.

Thus, aqueous plating solutions based upon trivalent chromium salts can be used to obtain a surface finish that is acceptable in the market place with the accompanying benefits of reduced health and safety hazards for the people using them and reduced risk of pollution to the environment.

For such application to deposits of trivalent chromium, the post-treatment of the chromium surface finish may be employed to block the micro-holes in the trivalent chromium deposit which otherwise give access to the corrosion inhibiting substrate. This prevents or delays exposure of the substrate to the environment on articles to which the trivalent chromium surface finish has been applied.

The post-treatment may block the micro-holes chemically by reacting with the substrate to form an insoluble corrosion product within the micro-holes. Alternatively, the post-treatment may block the micro-holes physically by depositing a substantially inert product within the micro-holes.

By filling the micro-holes in this way, the electrochemistry of the reactions that cause corrosion of the chromium surface finish of articles exposed to the environment is prevented thereby breaking the corrosion cycle.

In this way, corrosive attack is resisted until the chromium deposit itself is forced to corrode. At this point, a deposit of hexavalent chromium is equally susceptible and will not protect against corrosion any better than a deposit of trivalent chromium.

More particularly, the post-treatment limits the corrosion reaction enough to diminish chemical activity in the micro-holes. This stops the pH from dropping and allows the substrate and more especially any nickel which is exposed to remain passive beneath the chromium deposit.

Preferably, the pre-treatment involves the application of corrosion inhibiting material to the substrate. Preferred materials for this purpose are metals or alloys of silver although other materials may be used. Thus it is envisaged that metals or alloys of gold, platinum, rhodium, indium or ruthenium may be employed. Alternatively, co-deposition of two or more materials including nickel, cobalt, phosphorus or rare earth materials may also be beneficial.

Advantageously, the corrosion inhibiting material is applied to an article to be protected by electrodeposition to form a protective layer of substantially uniform thickness and the chromium surface finish is applied over the protective layer by electrodeposition so that the chromium adheres to the protective layer.

The thickness of the protective layer may be varied depending upon the intended application of the product to which it is applied and the minimum depth to provide adequate protection can be determined on an application to application basis.

Preferably, the post-treatment involves exposing the chromium surface finish to a conditioning material. Preferred conditioning materials include phosphates and silanes although other conditioning materials may be used.

The protective layer may be exposed through the chromium surface finish, for example by micro-holes in trivalent chromium surface finishes or by surface defects such as cracks in both trivalent and hexavalent surface finishes. Where phosphates are employed as the conditioning material, these react with the exposed protective layer to form insoluble corrosion products that fill and block any micro-holes or surface defects in the chromium surface finish. Where silanes are employed as the conditioning material, these fill and block any micro-holes or surface defects in the chromium surface finish.

The conditioning materials may be applied by immersion of articles to which the protective layer and chromium surface finish have previously been applied in a solution containing the conditioning material. Other methods of application may be employed such as spraying the chromium surface finish with a solution containing the conditioning material. After immersion, excess conditioning material may be removed from the chromium surface finish by immersion in or spraying with water or other suitable cleaning agent.

According to another aspect of the invention there is provided a method of providing a surface finish of chromium, preferably trivalent chromium, having improved corrosion resistance by applying the chromium surface finish over a protective layer and optionally applying a conditioning material to the chromium surface finish where the protective layer is exposed through the chromium surface finish.

Preferably, the protective layer will be provided by applying silver or silver alloy, for example by electrodeposition, prior to application of the chromium surface finish to an article to be protected. Other metals or alloys selected from the group of gold, platinum, rhodium, indium, and ruthenium may be employed. Alternatively, a co-deposition of two or more materials including nickel, cobalt, phosphorus or rare earth materials may be employed.

The article may be made of metal or plastic to which the protective layer may be applied directly but more usually one or more additional layers of metal or alloy are provided between the base material and the protective layer.

For example, when plating on different base metals including brass, zinc and steel, a number of variations of layers building up to the final protective layer may be employed prior to application of the chromium surface finish, and it is envisaged that the invention could be applied to any combination of layers and materials.

Advantageously, the conditioning material is applied by immersion in a suitable solution of the material. The conditioning material may be a phosphate or a silane that fill and block holes or defects in the surface of the chromium surface finish to prevent or restrict exposure of the protective layer to the environment in which the article is exposed in use.

According to yet another aspect of the present invention there is provided an article having a surface finish of chromium, preferably trivalent chromium, applied over a protective layer and optionally followed by a treatment with a conditioning material.

Typically the article will comprise a base material which may be metal, such as brass, zinc, steel, or plastic such as ABS grade material or other such grades of plastic that are suitable for plating. One of more layers of metals such as copper, nickel may be applied to the base material prior to application of the protective layer.

In a preferred embodiment, the protective layer comprises silver or silver alloy deposited by electrodeposition over which one or more layers of trivalent chromium are deposited from an aqueous plating solution of trivalent chromium ions to provide the chromium surface finish. Preferably, the thickness of the silver layer is at least 2 microns and more preferably at least 3 microns.

We have found when using a protective layer of silver or silver alloy that the resulting colour finish of the trivalent chromium closely matches the colour finish of hexavalent chromium. As a result, the mixing of trivalent chromium plated parts and hexavalent chromium plated parts with no visually discernible colour mis-match becomes a possibility with the present invention.

Silver or silver alloy may be replaced by other metals or alloys such as gold, platinum, rhodium, indium and ruthenium or a co-deposition of two or more materials including nickel, cobalt, phosphorus or rare earth materials which provide a protective layer under the final chromium deposit.

The protective layer has a thickness suitable for the intended application and this may be formed in one or more layers. Where several layers are applied to form the protective layer, these may be of the same or different metals or alloys.

Advantageously, the conditioning material is a phosphate or silane that acts to enhance the corrosion resistance by inhibiting exposure of the protective layer to the environment through the chromium surface finish and thereby prevent the corrosion reactions which cause the breakdown of the chromium surface finish.

According to another aspect of the present invention, there is provided a method of providing an article with a colour finish of trivalent chromium which substantially matches the colour finish of hexavalent chromium by the use of a material under the trivalent chromium plating to modify the colour finish of the trivalent chromium.

According to yet another aspect of the present invention there is provided an article having a surface finish of trivalent chromium applied over a material to modify the colour finish of the trivalent chromium to match substantially the colour finish of hexavalent chromium.

Preferably, the method of producing the article and the article employ silver or silver alloy onto which the trivalent chromium is plated to modify the colour finish of the resulting trivalent chromium plating. The silver or silver alloy also acts to enhance the corrosion resistance of the trivalent chromium plating as described above.

BRIEF DESCRIPTION OF THE DRAWINGS

The invention will now be described in more detail, by way of example only, with reference to the accompanying drawings wherein:

FIG. 3 shows the application of trivalent chromium surface finishes over bright silver with different combinations of underlayers.

DETAILED DESCRIPTION OF THE INVENTION

Samples were prepared in the form of discs (2 mm thick and 35 mm diameter) of 60/40 brass turned from an extruded rod section. The samples were polished using conventional polishing mops and bright polishing compound. They were cleaned using lime powder and proprietary cleaners prior to being plated. The samples were all plated with bright nickel by passing through a production plating plant using ultrasonic cleaning, soak cleaning, electrocleaning, acid dipping in fluoroboric acid and then nickel plating.

The nickel plated samples were then subjected to further plating as follows:

| Sample A | Sample B | Sample C |
|---|---|---|
| hexavalent chromium | trivalent chromium | Bright silver followed by trivalent chromium and a conditioning treatment |

The hexavalent chromium in sample A and trivalent chromium in samples B and C were produced by electrodeposition from aqueous plating solutions containing hexavalent chromium ions and trivalent chromium ions respectively.

The bright silver in sample 3 was produced using a cyanide based silver plating solution (Silvor 90 ex Engelhard-Cal) and the conditioning treatment was provided by dipping in a solution of a phosphate. All stages were interspersed with rinsing.

On completion, the plated samples were masked down to 1 cm square areas using an insulating coating of Macdermid Canning Lacomit material applied in four separate coats.

The samples were then immersed in hard water, pH 7.7 with high chloride content and subjected to an anodically stepped voltage, increased progressively from the respective rest potential in 50 mv steps using a Solartron Schlumberger 1286 Electrochemical Interface linked to a Solartron 1250 Frequency Response Analyser. The results of current density against potential were plotted in graphs shown in FIGS. 1 and 2 using a personal computer running "Corrware" software.

In the current vs potential plots, the lower the anodic potential at which the line rises above the X-axis the sooner the onset of corrosion. The lower the potential at which the tests stop the lower the corrosion resistance of the sample. The current flow becomes Faradaic and the chemical changes at the surface are permanent.

Figure 1:
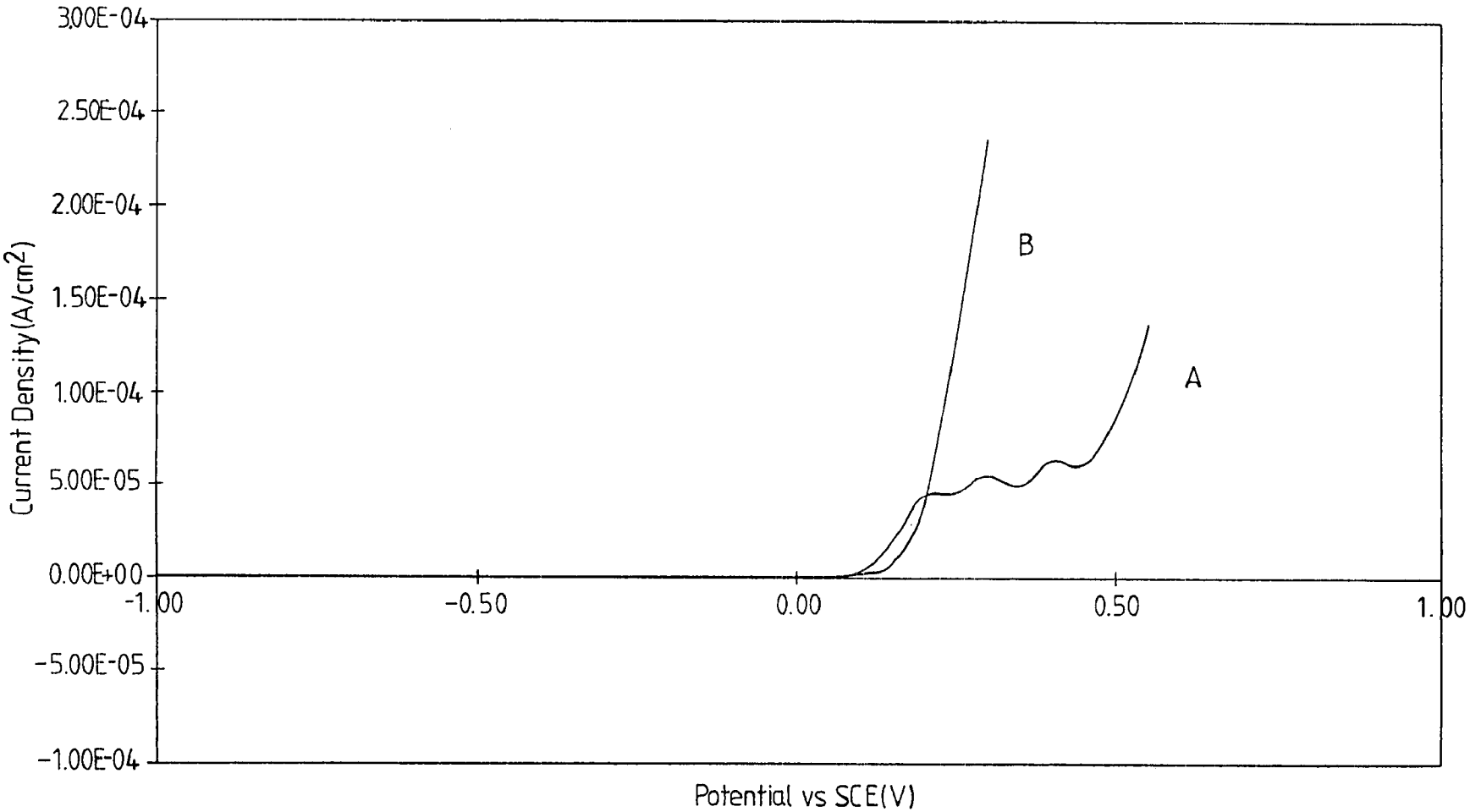
Fig. 1 PRIOR ART
FIG. 1 is a graph comparing the corrosion resistance of surface finishes of hexavalent and trivalent chromium over bright nickel.

FIG. 1 compares the corrosion resistance of hexavalent (sample A) and trivalent (sample B) deposits of chromium over bright nickel. It can be seen that the trivalent system (sample B) is less corrosion resistant than the hexavalent system (sample A).

Figure 2:
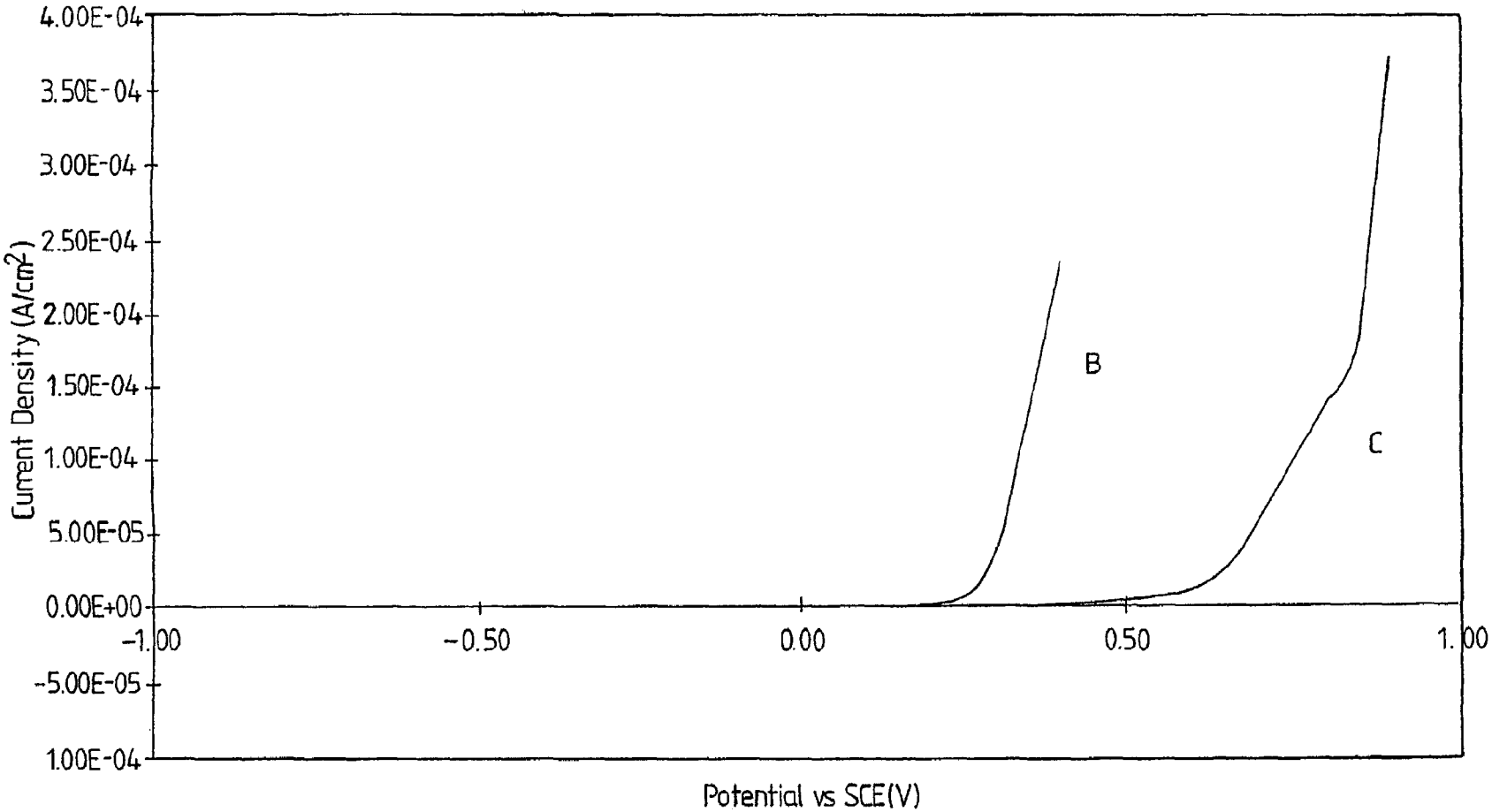
FIG. 2 is a graph comparing the corrosion resistance of surface finishes of trivalent chromium over bright nickel and trivalent nickel over bright silver over bright nickel.

FIG. 2 compares the corrosion resistance of the deposit of trivalent chromium over bright nickel (sample B) with a deposit of trivalent chromium over bright silver over bright nickel and conditioning treatment (sample C). It can be seen that the provision of the interlayer of silver followed by the conditioning treatment increases the corrosion resistance of the trivalent chromium.

Furthermore, by comparison with FIG. 1, it can be seen that the corrosion resistance of the deposit of trivalent chromium with the silver interlayer and conditioning treatment (sample C) is comparable with the deposit of hexavalent chromium (sample A) without any silver interlayer or conditioning treatment.

A further sample was prepared as described for sample C but without the final conditioning treatment and this was also found to have improved corrosion resistance compared to the deposit of trivalent chromium over bright nickel (sample B).

As will be appreciated, the provision of the silver or silver alloy interlayer and optional conditioning treatment enables a chromium surface finish to be obtained using a trivalent chromium plating solution having improved corrosion resistance compared with existing surface finishes of trivalent chromium and which does not have the hazards of the hexavalent chromium plating solutions commonly used. The improved corrosion resistance is believed to be due to the formation of insoluble silver phosphate in the microporous surface of the trivalent chromium deposit which acts to prevent further corrosion reactions from taking place.

Furthermore, provision of the silver or silver alloy interlayer and optional conditioning treatment can replace the semi bright nickel previously deposited under the bright nickel to improve corrosion resistance thereby offering potential savings in manufacturing costs. Thus, the silver or silver alloy interlayer of the present invention need only have a thickness of the order of 2 to 3 microns compared to a thickness of around 20 microns for the semi bright nickel previously employed. This lower thickness of silver or silver alloy compared with the semi bright nickel reduces the amount of material to be deposited. As a result, manufacturing costs may be reduced through savings in materials and improved efficiency from shorter plating times providing faster throughput of plated articles.

A further benefit of the silver or silver alloy interlayer is that the colour finish of the resulting trivalent chromium plating closely matches that of hexavalent chromium plating. In this way, problems of colour mis-match between chromium plated parts with trivalent and hexavalent chromium finishes are substantially avoided. As a result, it is possible for parts having trivalent chromium plating to be used with parts having hexavalent chromium plating without the different finishes being visually discernible.

FIG. 3 shows the application of the invention to provide a base metal with a trivalent chromium surface finish over a silver layer for different combinations of layers between the base metal and silver layer followed by a conditioning treatment. These are not exhaustive of the possible applications of the invention and are given purely to illustrate some of the available options. Other combinations will be apparent to those skilled in the art and are deemed within the scope of the invention.

It will also be understood that the invention is not limited to the use of a protective layer of silver or silver alloy and a phosphate conditioning treatment to improve the corrosion resistance of trivalent chromium surface finishes. Thus, other materials may be employed for the protective layer and/or conditioning treatment in combination with the electrodeposition of the trivalent chromium.

The material employed for the protective layer should adhere to the surface over which it is applied and provide a surface to which the chromium will adhere. Suitable materials other than silver or silver alloy include gold, platinum, rhodium, indium, ruthenium, and their alloys as well as co-deposited materials including nickel, cobalt, phosphorus and rare earth materials.

Similarly, the material selected for the conditioning treatment may itself be retained in any holes or cracks in the chromium surface finish or react with the material of the protective layer to form an insoluble product that is retained in any holes or cracks in the chromium surface finish to inhibit exposure of the protective layer to the surrounding environment. For example, the phosphate dip above-described may be replaced by a silane dip.

What is claimed is:

1. A process for producing a surface finish of chromium metal on a substrate comprising the steps of applying a layer of silver or silver alloy to the substrate prior to applying a surface finish of chromium metal directly on said layer of silver or silver alloy by electrodeposition from an aqueous plating solution of trivalent chromium ions whereby the corrosion resistance of the substrate is enhanced by the layer of silver or silver alloy inhibiting the corrosion reactions which cause the chromium metal to separate from the substrate when exposed to the environment through the chromium metal surface finish.

2. A process as claimed in claim 1, wherein the layer of silver or silver alloy is applied to the substrate by electrodeposition from an aqueous plating solution.

3. A process as claimed in claim 1, wherein the layer of silver or silver alloy is of substantially uniform thickness.

4. A process as claimed in claim 3, wherein the layer of silver or silver alloy has a thickness of at least 2 microns.

5. A process as claimed in claim 1, wherein the substrate is selected from the group comprising a metal and a metal alloy.

6. A process as claimed in claim 1, wherein the substrate is a plastics material.

7. A process as claimed in claim 1, further comprising a post-treatment of the chromium metal surface finish to block micro-holes or surface defects in the chromium metal surface finish.

8. A process as claimed in claim 7, wherein the post-treatment involves exposing the chromium metal surface finish to a conditioning material.

9. A process as claimed in claim 8, wherein the conditioning material is selected from the group consisting of a phosphate and a silane.

10. A process as claimed in claim 9, wherein the conditioning material blocks the micro-holes or surface defects chemically by reacting with the corrosion inhibiting material to form an insoluble corrosion product within the micro-holes or surface defects in the chromium metal surface finish.

11. A process as claimed in claim 9, wherein the conditioning material blocks the micro-holes or surface defects by depositing a substantially inert product within the micro-holes or surface defects in the chromium metal surface finish.

12. A process as claimed in claim 9, wherein the conditioning material is applied by immersion or spraying of the substrate to which the protective layer and chromium metal surface finish have previously been applied in a solution containing the conditioning material and, after immersion or spraying, excess conditioning material is removed from the chromium metal surface finish by immersion or spraying with water or other suitable cleaning agent.

13. A process as claimed in claim 4, wherein the layer of silver or silver alloy has a thickness of at least 3 microns.

* * * * *